US011013950B2

(12) United States Patent
Dobronyi

(10) Patent No.: US 11,013,950 B2
(45) Date of Patent: May 25, 2021

(54) PORTABLE FOLDABLE SURFACE

(71) Applicant: Rachel M. Dobronyi, Corte Madera, CA (US)

(72) Inventor: Rachel M. Dobronyi, Corte Madera, CA (US)

( * ) Notice: Subject to any disclaimer, the term of this patent is extended or adjusted under 35 U.S.C. 154(b) by 270 days.

(21) Appl. No.: 15/709,286

(22) Filed: Sep. 19, 2017

(65) Prior Publication Data

US 2018/0104530 A1 Apr. 19, 2018

Related U.S. Application Data

(60) Provisional application No. 62/410,069, filed on Oct. 19, 2016.

(51) Int. Cl.
*A63B 21/00* (2006.01)
*A47G 27/02* (2006.01)

(52) U.S. Cl.
CPC ..... *A63B 21/4037* (2015.10); *A47G 27/0212* (2013.01); *A47G 27/0218* (2013.01); *A47G 27/0237* (2013.01); *A63B 2209/00* (2013.01); *A63B 2209/02* (2013.01); *A63B 2210/50* (2013.01); *A63B 2225/09* (2013.01)

(58) Field of Classification Search
CPC ..... A63B 21/4037; A63B 2209/00; A63B 2209/02; A63B 2210/50; A63B 2225/09; A47G 27/0237; A47G 27/0212; A47G 27/0218
See application file for complete search history.

(56) References Cited

U.S. PATENT DOCUMENTS

| | | | | |
|---|---|---|---|---|
| 3,284,819 | A * | 11/1966 | Nissen | A63C 19/04 5/420 |
| 5,066,001 | A * | 11/1991 | Wilkinson | A63B 6/00 482/52 |
| D339,265 | S | 9/1993 | Claesson | |
| 7,128,668 | B2 | 10/2006 | Purcell | |
| 8,744,610 | B2 * | 6/2014 | Kling | G06T 17/20 700/133 |
| D751,859 | S * | 3/2016 | Lion | D7/388 |
| 2005/0039260 | A1 * | 2/2005 | Tyler | A41D 15/04 5/417 |

(Continued)

*Primary Examiner* — Nicholas F Polito
*Assistant Examiner* — Morgan J McClure
(74) *Attorney, Agent, or Firm* — Roeder & Broder LLP; James P. Broder

(57) ABSTRACT

A foldable surface for supporting a user relative to a support surface during an activity includes at least three surface panels that are movably coupled to one another with one or more panel connectors. Each of the surface panels includes (i) a rigid base layer having a base layer first surface that faces in a first direction, and (ii) a resilient layer that is adjacent to the base layer, the resilient layer having a resilient layer second surface that faces in a second direction that is substantially opposite the first direction. The surface panels are movable between an open configuration wherein the surface panels cooperate to form a substantially planar surface that can be positioned adjacent to the support surface, and a stacked configuration wherein the surface panels are positioned substantially side-by-side with the base layer first surface of one surface panel directly facing the base layer first surface of an adjacent surface panel.

20 Claims, 4 Drawing Sheets

(56) References Cited

U.S. PATENT DOCUMENTS

| | | | | |
|---|---|---|---|---|
| 2005/0049125 | A1* | 3/2005 | Cloutier | A63B 21/0004 482/142 |
| 2009/0056016 | A1* | 3/2009 | Zack | A47G 27/025 5/417 |
| 2014/0272854 | A1* | 9/2014 | Morrow | A47G 27/0237 434/247 |
| 2016/0129299 | A1* | 5/2016 | Newman | A63B 21/4037 482/142 |
| 2016/0375296 | A1* | 12/2016 | Downey | A63B 21/4037 52/506.01 |
| 2017/0291059 | A1* | 10/2017 | Lin | A63B 21/4037 |
| 2018/0099171 | A1* | 4/2018 | Chen | A63B 5/16 |

* cited by examiner

PORTABLE FOLDABLE SURFACE

RELATED APPLICATION

This application claims priority on U.S. Provisional Application Ser. No. 62/410,069, filed on Oct. 19, 2016, entitled "PORTABLE FOLDABLE SURFACE". As far as permitted, the contents of U.S. Provisional Application Ser. No. 62/410,069 are incorporated herein by reference.

BACKGROUND

Yoga is a group of physical, mental, and spiritual practices or disciplines which originated in ancient India. Realized physical benefits from yoga include, but are not limited to, increased flexibility, improved respiration, energy and vitality, increased muscle strength and tone, weight reduction, protection from injury, improved cardio and circulatory health, enhanced metabolism balance, and improved athletic performance. Additionally, regular practice of yoga can help a person manage stress, which is known to have devastating effects on the mind and body.

Yoga has been practiced more and more broadly in the modern, western world since the late 1800's. Recently, there has been increased interest among yoga practitioners (as well as other types of exercise or meditation practitioners) for participating in yoga in an outdoor setting. It has been said by some that natural uneven surfaces such as sand, grass or the woodland floor can intensify a yoga posture and its physical benefits. For example, slight variance in terrain can focus balance more than a flat floor and can build the secondary muscles of the practitioner's feet, hips, knees, spine, and shoulders. Unfortunately, such outdoor settings can also have certain drawbacks or limitations, such as lack of stability in the support surface for the practitioner, as well as a lack of protection from the weather that may be experienced in the outdoor setting.

SUMMARY

The present invention is directed toward a foldable surface for supporting a user relative to a support surface during an activity. In various embodiments, the foldable surface includes at least three surface panels that are movably coupled to one another with one or more panel connectors. Each of the surface panels includes (i) a rigid base layer having a base layer first surface that faces in a first direction, and (ii) a resilient layer that is positioned adjacent to the base layer, the resilient layer having a resilient layer second surface that faces in a second direction that is substantially opposite the first direction. The surface panels are movable between an open configuration wherein at least three surface panels cooperate to form a substantially planar surface that is adapted to be positioned adjacent to the support surface, and a stacked configuration wherein at least three surface panels are positioned substantially side-by-side with the base layer first surface of one surface panel directly facing the base layer first surface of an adjacent surface panel.

In some embodiments, the foldable surface further includes a cover that substantially surrounds the rigid base layer and the resilient layer.

Additionally, in certain embodiments, the rigid base layer is formed from at least one of tempered hardboard, plywood, and aluminum.

Further, in certain embodiments, when the surface panels are in the stacked position, the resilient layer second surface of one surface panel directly faces the resilient layer second surface of an adjacent surface panel.

In some embodiments, the resilient layer is formed from at least one of thermoplastic elastomer, natural rubber and neoprene.

In some embodiments, the foldable surface is configured to support the user during a yoga activity, a meditation activity, an exercise activity, or another type of activity. As provided herein, the foldable surface can be used to support the user relative to the support surface during such an activity. For example, in one embodiment, the support surface is an uneven support surface, such as may be found in an outdoor environment, and the foldable surface can effectively smooth out any unstable inconsistencies in the support surface.

Further, in certain embodiments, each of the surface panels has a configuration that is one of substantially triangle-shaped and substantially diamond-shaped. Still further, in some such embodiments, each of the surface panels has a configuration that is substantially triangle-shaped.

Additionally, in some embodiments, the one or more panel connectors form a predetermined folding pattern between adjacent surface panels.

In various embodiments, the resilient layer has a resilient layer thickness and the rigid base layer has a rigid base thickness. In some such embodiments, a thickness ratio of the resilient layer thickness to the rigid base thickness is at least approximately 2:1.

The present invention is also directed toward a foldable surface assembly including a plurality of foldable surfaces as described above that have been coupled together with a coupling assembly. For example, in one such embodiment, the plurality of foldable surfaces includes a first foldable surface and a second foldable surface. In such embodiment, the second movable surface can be movably coupled to the first foldable surface with the coupling assembly so that the foldable surface assembly can be alternatively positioned in a first configuration and a second configuration that is different than the first configuration.

Additionally, the present invention is further directed toward a foldable surface for supporting a user relative to a support surface during an activity, the foldable surface including a plurality of surface panels that are movably coupled to one another with panel connectors, each of the surface panels having a first surface and an opposing second surface, the surface panels being movable between an open configuration wherein the first surfaces of the surface panels cooperate to form a substantially planar surface that is adapted to be positioned adjacent to the support surface, and a stacked configuration wherein the surface panels are positioned substantially side-by-side with the first surface of one surface panel directly facing the first surface of an adjacent surface panel; wherein the panel connectors form a predetermined folding pattern between adjacent surface panels; and wherein each of the surface panels has a configuration that is one of substantially triangle-shaped and substantially diamond-shaped.

The present invention is also directed toward a method of manufacturing a foldable surface that is usable for supporting a user relative to a support surface during an activity. The method of manufacturing can alternatively include manufacturing any of the foldable surfaces described herein.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a portable, foldable surface that can be used to support a user relative to a support surface during performance of an activity, e.g., a yoga activity, a meditation activity, an exercise activity, camping, or another type of activity. Additionally, as provided herein, in various embodiments, the unique configuration of the foldable surface enables the foldable surface to be used effectively to support the user relative to any type of support surface, such as an uneven support surface that is more likely found in an outdoor environment.

Those of ordinary skill in the art will realize that the following detailed description of the present invention is illustrative only and is not intended to be in any way limiting. Other embodiments of the present invention will readily suggest themselves to such skilled persons having the benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
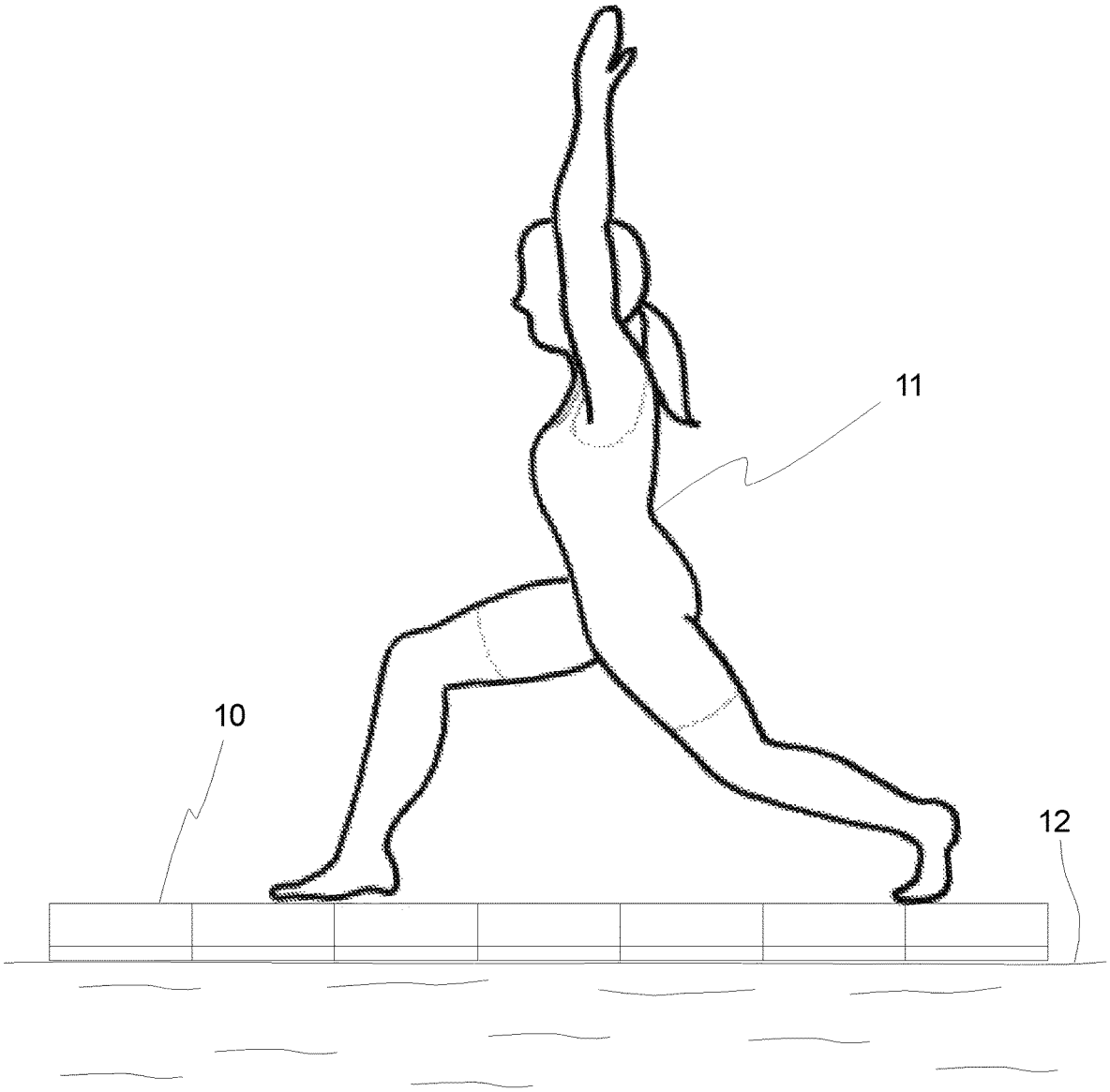
FIG. 1A is a simplified schematic side view illustration of an embodiment of a foldable surface having features of the present invention, and a user that is using the foldable surface.

FIG. 1A is a simplified schematic side view illustration of an embodiment of a foldable surface 10 having features of the present invention, and a user 11 that is using the foldable surface 10. In particular, the foldable surface 10 is illustrated in FIG. 1A as being positioned on a support surface 12, e.g., an uneven support surface such as one that could be found in an outdoor setting. Thus, the foldable surface 10 is intended to support the user 11 relative to the support surface 12 during yoga, meditation, camping or any other suitable exercise or activity.

In certain non-exclusive embodiments, the support surface 12 can be found in various natural outdoor environments such as a beach, a yard, a forest, a rural and/or farm area, a park, a rooftop, a coastal bluff, a lakeshore, a mountain top, and a meadow. Alternatively, the support surface 12 can be found in other locations or environments. Still alternatively, it should be appreciated that although the foldable surface 10 of the present invention is primarily described as being usable with an uneven support surface 12, the foldable surface 10 can also equally be usable with an even or substantially level or planar support surface 12.

Additionally, it should also be appreciated that although the foldable surface 10 is primarily described herein as being used during the practice of yoga, there is no intent to limit the use of the foldable surface 10 in any such manner. Stated in another fashion, the foldable surface 10 can be used for various activities other than yoga, and any specific connection to the practice of yoga is not intended to be limiting of the scope of the present invention in any manner.

As an overview, in various embodiments, the foldable surface 10 incorporates a modular design to enable the foldable surface 10 to be easily and effectively used on an uneven support surface 12. In such embodiments, the modular design of the foldable surface 12 enables the foldable surface 10 to help smooth out any unstable inconsistencies in the support surface 12. For example, the foldable surface 10 can be positioned on the support surface 12, with the ability to adjust to the particularities of the support surface 12, e.g., by providing added support and comfort beneath a yoga mat. As such, the modular design helps to address the lack of opportunity for effectively practicing yoga, meditation or other activities outdoors in a group or individual setting. More particularly, as provided herein below, the foldable surface 10 is formed from a combination of materials that responds to the changing natural landscape, and that enables stable support for the user, while still being able to adapt to the inconsistent or uneven nature of various outdoor setting surfaces.

Further, the foldable surface 10 can be used individually or in combination with additional foldable surfaces 10. For example, a plurality of similar foldable surfaces 10 can be used in conjunction with one another in the formation of a foldable surface assembly 218 (illustrated in FIG. 2). As such, the foldable surface assembly 218 can provide a larger overall surface for use by multiple people. Alternatively, at least one of the foldable surfaces 10 of the foldable surface assembly 218 can be positioned at least in a partially upright manner to better protect the user from any unwanted environmental elements, e.g., as a windscreen.

Figure 1B:
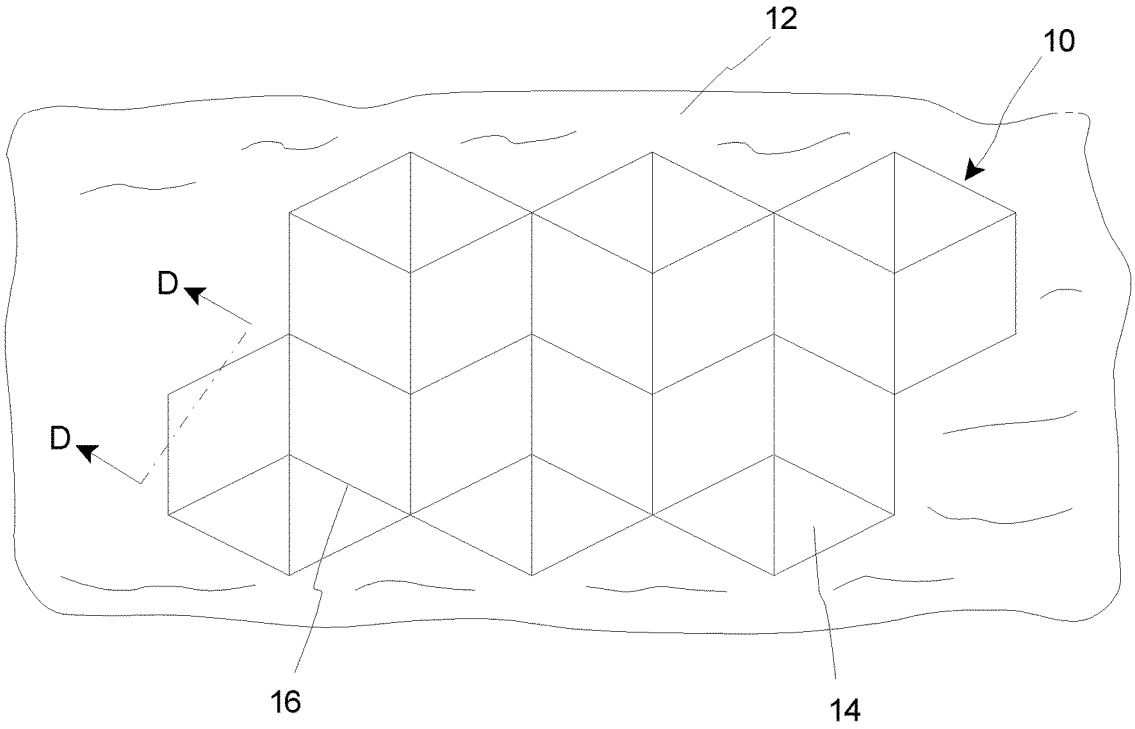
FIG. 1B is a simplified schematic top view illustration of the foldable surface illustrated in FIG. 1A, the foldable surface being in an open configuration.

FIG. 1B is a simplified schematic top view illustration of the foldable surface 10 illustrated in FIG. 1A. In particular, the foldable surface 10 is again illustrated as being positioned on the support surface 12.

Figure 1C:
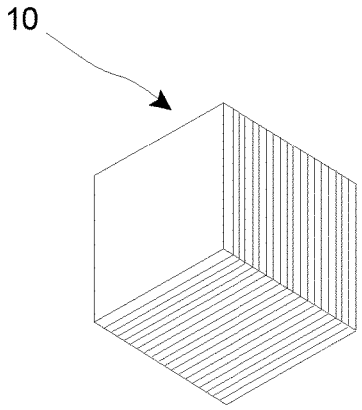
FIG. 1C is a simplified schematic perspective view of the foldable surface illustrated in FIG. 1A, the foldable surface being in a stacked configuration.

The design of the foldable surface 10 can be varied. For example, in various embodiments, as shown in FIG. 1B, the foldable surface 10 can include a plurality of surface panels 14 that are movably and/or foldably coupled to one another. As such, the foldable surface 10 can effectively provide a yoga surface having predetermined edges or junctions between adjacent surface panels 14 for folding and manipulating of the foldable surface 10, e.g., in a predetermined folding pattern. In particular, with this design, the foldable surface 10 can be selectively moved between an open (planar) configuration (as shown in FIG. 1B) and a stacked (folded) configuration (as shown in FIG. 1C). In the open configuration, the surface panels 14 are laid out to form a substantially planar surface configuration that can be positioned substantially or directly adjacent to the support surface 12. Conversely, in the stacked configuration, the surface panels 14 have been moved and/or folded relative to one another, e.g., in a predetermined manner, such that the surface panels 14 are substantially side-by-side in a compact form for ease in storage, carrying or otherwise transporting from one location to another.

The foldable surface 10 can include any suitable number of surface panels 14. For example, in one non-exclusive embodiment as shown in FIG. 1B, the foldable surface 10 can include twenty-four individual surface panels 14 that are movably coupled to one another. Alternatively, the foldable surface 10 can include greater than twenty-four or less than twenty-four surface panels 14 that are movably coupled to one another.

In the embodiment specifically illustrated in FIG. 1B, each of the surface panels 14 has a configuration that is either substantially triangle-shaped or substantially diamond-shaped. Additionally, each of the surface panels 14 is movably coupled to one or more of the other surface panels 14 by a flexible, panel connector 16. As such, the panel connectors 16 effectively form the predetermined edges or junctions between adjacent surface panels 14 for folding and manipulating of the foldable surface 10 in a predetermined folding pattern. Alternatively, the surface panels 14 can be formed to be different shapes than those specifically illustrated in FIG. 1B, and/or the surface panels 14 can be coupled together in a different manner (e.g., a different design) than is shown in FIG. 1B. For example, in certain, non-exclusive alternative embodiments, one or more of the surface panels 14 can have a configuration that is substantially square-shaped, rectangle-shaped, triangle-shaped, pentagon-shaped, hexagon-shaped, octagon-shaped, or any other suitable shape.

As provided herein, the surface panels 14 are configured to be movable, e.g., foldable, relative to adjacent surface panels 14 via the panel connectors 16. With this design, the foldable surface 10 can be relatively quickly and easily folded into the stacked configuration, i.e. into a compact overall package for ease of transport (portability) and storage. Additionally, the foldable surface 10 can also be relatively quickly and easily moved from the stacked configuration to the open configuration and set up on the support surface 12 for use as desired.

The panel connectors 16 can have any suitable design. For example, in some embodiments, the panel connectors 16 include a stitched seam that enables the desired movement between adjacent surface panels 14. Alternatively, the panel connectors 16 can have another suitable design.

It is appreciated that to enable the desired predetermined folding patterns for the foldable surface 10, not all of the surface panels 14 are necessarily directly connected to each adjacent surface panel 14 with a panel connector 16. For example, in certain non-exclusive embodiments, when in the open configuration, some of the surface panels 14 may be positioned directly adjacent to one or more other surface panels 14 without being movably secured to all such other surface panels 14 with a panel connector 16. This enables for greater variation in the predetermined folding (and unfolding) patterns that may be applicable in moving the foldable surface 10 between the open configuration and the stacked configuration. It is further appreciated that it is merely necessary that enough panel connectors 16 are provided between adjacent surface panels 14 so that the foldable surface 10 is maintained as a single entity. As such, each surface panel 14 must be movably secured to at least one adjacent surface panel 14 with a panel connector 16.

The overall size and shape of the foldable surface 10 can be varied. In certain non-exclusive embodiments, the foldable surface 10, when in the open configuration, is designed to be of sufficient size to accommodate a standard-sized yoga mat with extra space for yoga props, a water bottle, a backpack, extra clothing, or other suitable items.

FIG. 1C is a simplified schematic perspective view of the foldable surface 10 illustrated in FIG. 1A, the foldable surface 10 being in the stacked (folded) configuration. In particular, as noted above, when in the stacked configuration, the surface panels 14 are positioned or stacked relative to one another substantially side-by-side in a compact form for ease in storage, carrying or otherwise transporting from one location to another.

Figure 1D:
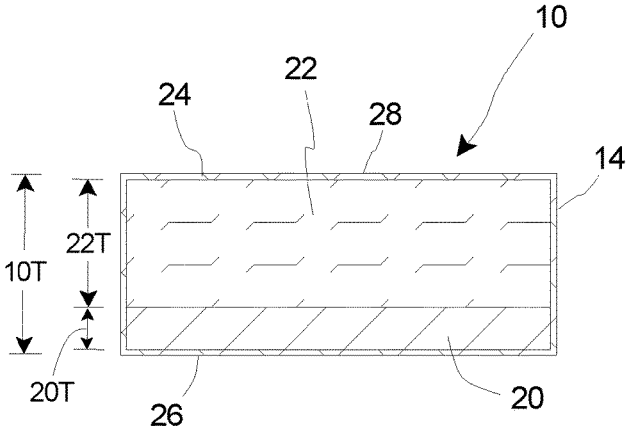
FIG. 1D is a cross-sectional view of the foldable surface taken on line D-D in FIG. 1A.

FIG. 1D is a cross-sectional view of the foldable surface 10 taken on line D-D in FIG. 1B. In particular, FIG. 1D illustrates the general material make-up of certain embodiments of the foldable surface 10. For example, in certain embodiments, the foldable surface 10 and/or each of the surface panels 14 can include a rigid base layer 20, a resilient layer 22, and a cover 24. Alternatively, the foldable surface 10 can be formed from more components or fewer components than those specifically illustrated in FIG. 1D. For example, in one non-exclusive alternative embodiment, the foldable surface 10 can be formed without the rigid base layer, 20, the resilient layer 22 and/or the cover 24.

During most applications and uses of the foldable surface 10, the rigid base layer 20 is configured to face the support surface 12 (illustrated in FIG. 1A). In various embodiments, the rigid base layer 20 is generally rigid and can be made of a rigid material such as tempered hardboard, bamboo, plywood, aluminum, plastic, carbon fiber, various other composite materials, or other suitably rigid materials that provide the desired support for the user. The positioning of the rigid base layer 20 directly adjacent to and/or facing the support surface 12 enables the foldable surface 10 to better provide desired stability for the user 11 (illustrated in FIG. 1A) when used on a support surface 12 that may include uneven or less stable surface features.

The thickness, weight and strength characteristics of the rigid base layer 20 can be varied. For example, in certain non-exclusive alternative embodiments, the rigid base layer 20 can have a rigid base thickness 20T of between approximately 1/64 inches and 1/2 inches. Alternatively, the rigid base layer 20 can have a rigid base thickness 20T that is greater than 1/2 inches or less than 1/64 inches. Additionally, in certain non-exclusive alternative embodiments, the rigid base layer 20 can have a base weight of between approximately 2.0 and 15.0 ounces per square foot. Alternatively, the rigid base layer 20 can have a base weight that is greater than 15.0 ounces per square foot or less than 2.0 ounces per square foot.

In one non-exclusive embodiment, the rigid base layer 20 can be formed from tempered hardboard, having a rigid base thickness 20T of approximately 1/8 inches, with a base weight of approximately 9.44 ounces per square foot, and with strength characteristics of approximately 3000 psi parallel and approximately 130 psi perpendicular. Still alternatively, the rigid base thickness 20T, base weight and/or strength characteristics of such embodiment can be greater than or less than the foregoing values.

In another non-exclusive alternative embodiment, the rigid base layer 20 can be formed from Forest Stewardship Council (FSC) certified plywood, having a rigid base thickness 20T of approximately ¼ inches, with a base weight of approximately 11.36 ounces per square foot, and with strength characteristics of approximately 11,000 psi parallel and approximately 104 psi perpendicular. Still alternatively, the rigid base thickness 20T, base weight and/or strength characteristics of such embodiment can be greater than or less than the foregoing values.

In still another non-exclusive alternative embodiment, the rigid base layer 20 can be formed from aluminum, having a rigid base thickness 20T of approximately 1/64 inches, with a weight of approximately 4.3 ounces per square foot, and with strength characteristics of approximately 16,000 psi parallel. Still alternatively, the rigid base thickness 20T, weight and/or strength characteristics of such embodiment can be greater than or less than the foregoing values.

As shown, in various embodiments, the resilient layer 22 is positioned adjacent to the rigid base layer 20. For example, in some such embodiments, the resilient layer 22 is positioned on top, e.g., directly on top, of the rigid base layer 20, i.e. when the foldable surface 10 is positioned on the support surface 12 in the open configuration. Additionally, the resilient layer 22 can be secured to the rigid base layer 20 in any suitable manner. For example, in certain non-exclusive alternative embodiments, the resilient layer 22 can be secured to the rigid base layer 20 with an adhesive material, with hook-and-loop material, with staples, or with other suitable attachment measures.

The resilient layer 22 provides a resilient cushion for the comfort of the person using the foldable surface 10. Non-exclusive examples of suitable materials for the resilient layer 24 include thermoplastic elastomer, natural rubber (e.g., from repurposed or recycled yoga mats), neoprene (e.g., from recycled wetsuits), various types of foam materials, fleece pads, etc.

Additionally, the resilient layer 22 can have any desired thickness. For example, in certain embodiments, the resilient layer 22 can have a resilient layer thickness 22T of between approximately ⅛ inches and one inch. Alternatively, the resilient layer 22 can have a resilient layer thickness 22T that is greater than one inch or less than ⅛ inches.

Further, the foldable surface 10 can include a thickness ratio between the resilient layer thickness 22T and the rigid base thickness 20T. For example, in certain embodiments, the thickness ratio of the resilient layer thickness 22T to the rigid base thickness 20T can be between approximately 1:1 and 20:1. More particularly, in such non-exclusive embodiments, the thickness ratio of the resilient layer thickness 22T to the rigid base thickness 20T can be at least approximately 1:1, 1.5:1, 2:1, 3:1, 5:1, 7:1, 10:1, 12:1, 15:1, 17:1 or 20:1. Alternatively, the foldable surface 10 can have a thickness ratio of the resilient layer thickness 22T to the rigid base thickness 20T of greater than 20:1 or less than 1:1.

The cover 24 can help to maintain the positioning of the resilient layer 22 relative to the rigid base layer 20. Additionally, the cover 24 can substantially surround the rigid base layer 20 and the resilient layer 22 and can provide a protective covering for the rigid base layer 20 and the resilient layer 22. In certain non-exclusive alternative embodiments, the cover 24 can comprise a fabric shell that is formed from one or more of ripstop nylon, silicone coated polyester, double-coated silnylon, leather, vinyl, plastic or cloth. Additionally, the cover 24 can also be designed to be waterproof, be easy to clean and be durable. In certain embodiments, the cover 24 can also provide a certain degree of slip-resistance to further enhance the activities of the user 11.

As shown in the embodiment illustrated in FIG. 1D, the cover 24 can substantially, if not completely, surround the resilient layer 22 and the rigid base layer 20 to help maintain the relative positioning between the resilient layer 22 and the rigid base layer 20. Alternatively, in other embodiments, the cover 24 can be configured such that the cover 24 does not substantially surround the rigid base layer 20. In some such alternative embodiments, the cover 24 can be secured to the rigid base layer 20 with adhesives, staples or other suitable attachment measures.

Additionally, as illustrated in FIG. 1D, the foldable surface 10 can have any desired overall thickness. For example, in certain non-exclusive embodiments, the foldable surface 10 can have a surface thickness 10T of between approximately ¼ inches and 1½ inches. Alternatively, the foldable surface 10 can have a surface thickness 10T that is greater than 1½ inches or less than ¼ inches.

With the design of the foldable surface 10 as provided herein, and the particular materials usable in the manufacturing of the foldable surface 10, the foldable surface 10 and/or the individual surface panels 14 can include (i) a rigid, first (outer) surface 26 that is configured to face toward the support surface 12 during use of the foldable surface 10, and (ii) an opposed, resilient, second (outer) surface 28 that faces away from the support surface 12 and is configured to provide resilient support for the user of the foldable surface 10. The combination of materials utilized to form the foldable surface 10 thus create a firm yet comfortable surface on which to practice yoga, meditation or other suitable activities, regardless of the nature of the support surface 12.

More particularly, in embodiments where the cover substantially surrounds the resilient layer 22 and the rigid base layer 20, (i) the cover 24 and the rigid base layer 20 cooperate to form the rigid, first surface 26 that faces in a first direction; and (ii) the cover 24 and the resilient layer 22 cooperate to form the resilient, second surface 28 that faces in a second direction that is substantially opposite to the first direction. Additionally, the rigid base layer 20 can have a base layer first surface that faces in the first direction, and the resilient layer 22 can have a resilient layer second surface that faces in the second direction.

It should be appreciated that when the foldable surface 10 is in the stacked configuration, the first (outer) surface 26 of one surface panel 14 is positioned substantially adjacent to and directly faces the first (outer) surface 26 of another surface panel 14; and the second (outer) surface 28 of one surface panel 14 is positioned substantially adjacent to and directly faces the second (outer) surface 28 of another surface panel 14. More particularly, in certain embodiments, when the foldable surface 10 and/or the surface panels 14 are in the stacked configuration, the surface panels 14 are positioned substantially side-by-side such that the base layer first surface of one surface panel 14 directly faces the base layer first surface of an adjacent surface panel 14; and the resilient layer second surface of one surface panel 14 directly faces the resilient layer second surface of an adjacent surface panel 14.

Figure 2A:
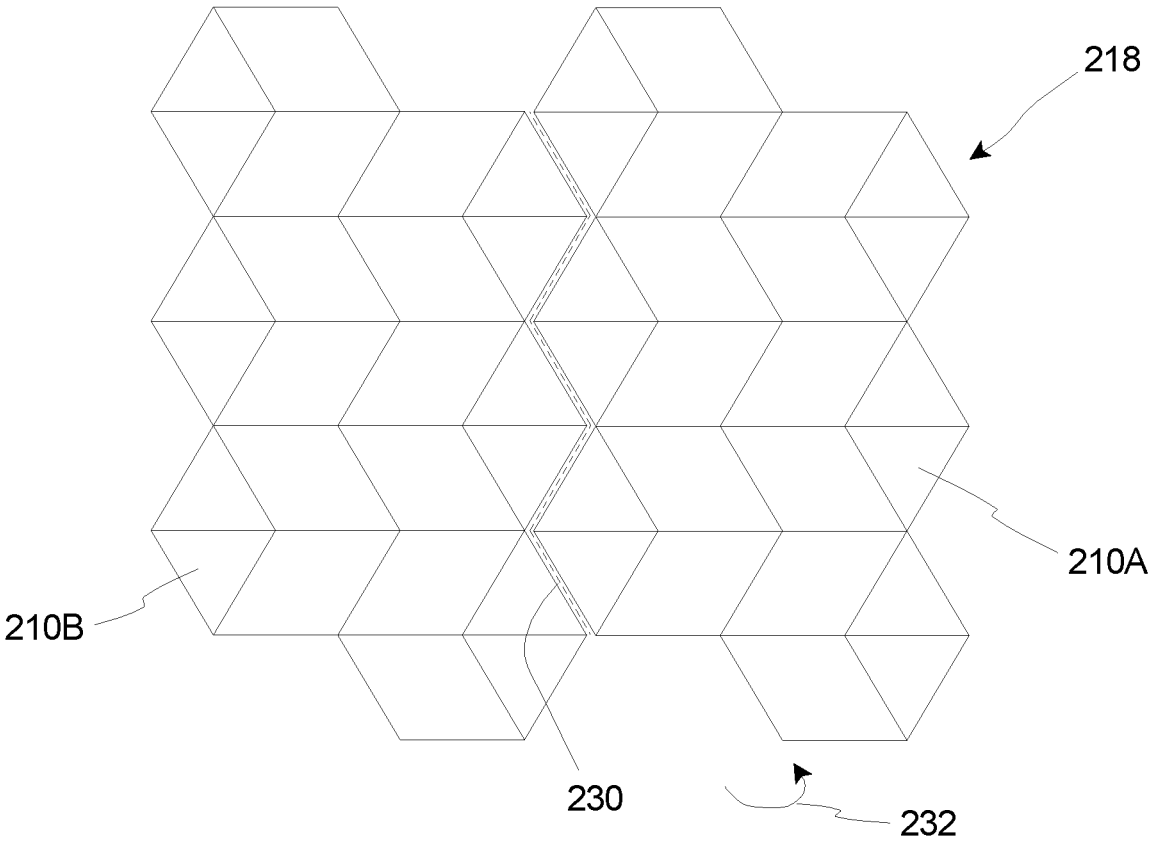
FIG. 2A is a simplified schematic top view illustration of a pair of foldable surfaces as illustrated in FIG. 1A that have been coupled together, the pair of foldable surfaces forming a foldable surface assembly that is in a first configuration.

FIG. 2A is a simplified schematic top view illustration of a pair of foldable surfaces 210A, 210B as illustrated in FIG. 1A that have been coupled together. In particular, FIG. 2A illustrates a foldable surface assembly 218 that is formed from a first foldable surface 210A and a second foldable surface 210B that have been selectively coupled together. It should be appreciated that the foldable surface assembly 218 can include any number (e.g., two or more) of individual foldable surfaces 210A, 210B.

As shown, the foldable surfaces 210A, 210B can be coupled together with a coupling assembly 230 (the general positioning of which is illustrated by a dashed line). The coupling assembly 230 can have any suitable design. For example, in certain non-exclusive alternative embodiments, the coupling assembly 230 can include hook-and-loop material, snaps, buttons, hooks, adhesive, etc. Alternatively, the foldable surfaces 210A, 2108 can simply be placed adjacent to one another without the use of a coupling assembly 230.

As provided herein, the foldable surface assembly 218 can be positioned in any suitable manner relative to the support surface 12 (illustrated in FIG. 1A). For example, as shown in FIG. 2A, the foldable surface assembly 218 can be laid out in a first configuration, i.e. with both foldable surfaces 210A, 210B being positioned substantially horizontally along the support surface 12, to enable multiple persons to use the foldable surface assembly 218 at any given time. Alternatively, as shown in FIG. 2B, the foldable surface assembly 218 can be positioned in another configuration, e.g., a second configuration.

Figure 2B:
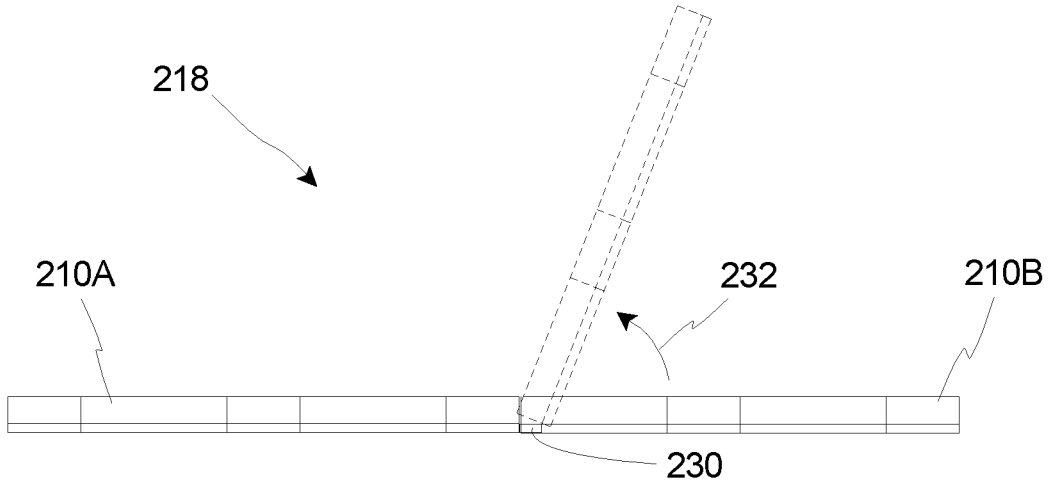
FIG. 2B is a simplified schematic side view illustration of the pair of foldable surfaces illustrated in FIG. 2A, with the foldable surface assembly being illustrated as movable between the first configuration and a second configuration.

FIG. 2B is a simplified schematic side view illustration of the pair of foldable surfaces 210A, 210B illustrated in FIG. 2A. As illustrated in FIG. 2B, the foldable surface assembly 218 is selectively movable between the first configuration (where the second foldable surface 210B is illustrated in solid lines) and a second configuration (where the second foldable surface 210B is illustrated in dashed lines). More particularly, as shown, the foldable surface assembly 218 can be positioned at least in part in a vertical manner relative to the support surface 12 to form a structure that can provide shelter or some means of protection from the environmental elements that may be present. In certain applications, the foldable surface assembly 218 can be positioned at least somewhat vertically to provide a windscreen for the user(s) 11 (illustrated in FIG. 1A). For example, in such applications the second foldable surface 210B can be rotated relative to the first foldable surface 210A (such as shown by arrow 232) about or along the junction between the foldable surfaces 210A, 210B, e.g., that can be formed by the coupling assembly 230.

It should also be appreciated that additional components can also be used with the foldable surface assembly 218 to create even more options for the user(s) 11. For example, in certain non-exclusive embodiments, lights can be added, e.g. for evening use, or speakers can be coupled to the foldable surface assembly 218 to enable the playing of music or other sounds.

Figure 3:
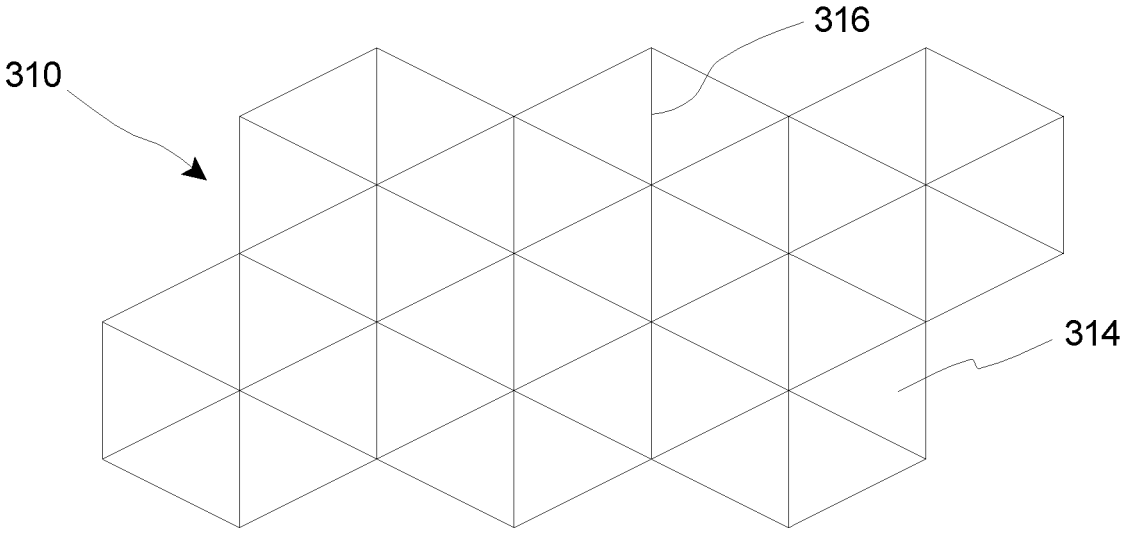
FIG. 3 is a simplified schematic top view illustration of another embodiment of the foldable surface.

FIG. 3 is a simplified schematic top view illustration of another embodiment of the foldable surface 310 illustrated in FIG. 1A. As illustrated, the foldable surface 310 is somewhat similar to the foldable surface 10 illustrated and described above. For example, the foldable surface 310 again includes a plurality of surface panels 314 that are coupled together with adjacent surface panels 314 utilizing one or more panel connectors 316. However, as shown in FIG. 3, in this embodiment, each of the surface panels 314 has a configuration that is substantially triangle-shaped.

Figure 4:
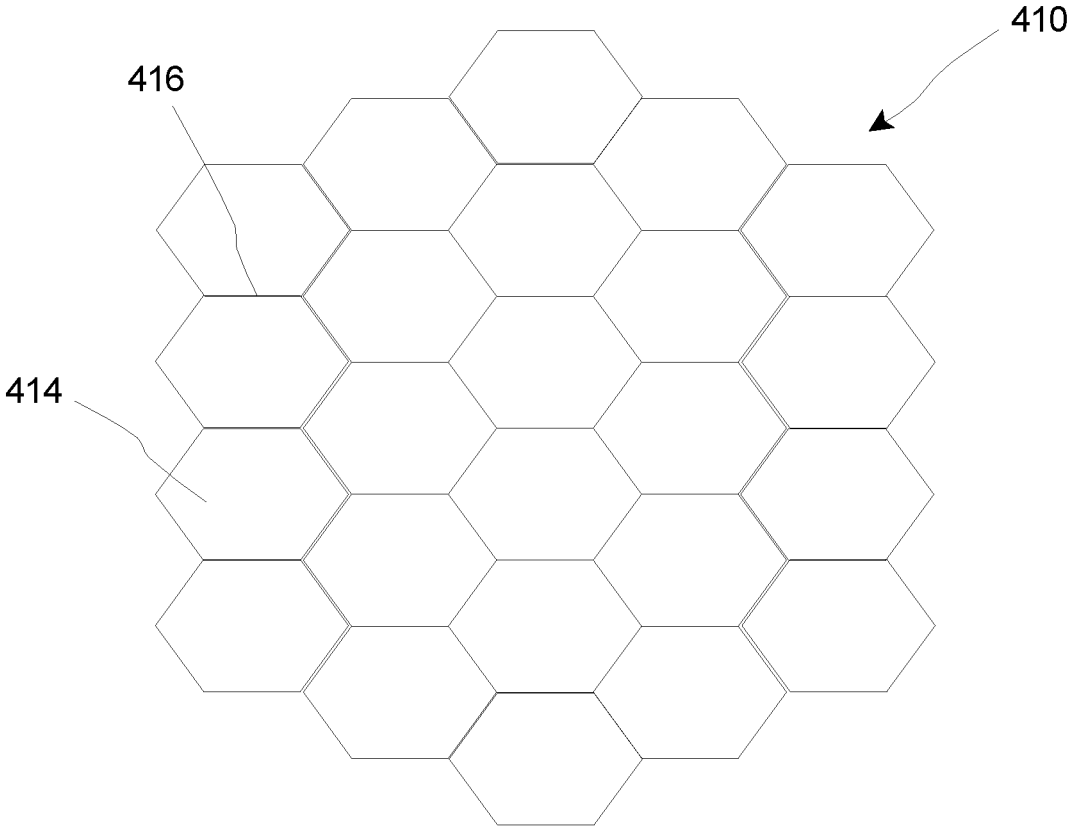
FIG. 4 is a simplified schematic top view illustration of still another embodiment of the foldable surface.

FIG. 4 is a simplified schematic top view illustration of still another embodiment of the foldable surface 410 illustrated in FIG. 1A. As illustrated, the foldable surface 410 is somewhat similar to the foldable surfaces 10, 310 illustrated and described above. For example, the foldable surface 410 again includes a plurality of surface panels 414 that are coupled together with adjacent surface panels 414 utilizing one or more panel connectors 416. However, in this embodiment, each of the surface panels 414 has a configuration that is substantially hexagon-shaped.

It is understood that although a number of different embodiments of a foldable surface 10 have been described herein, one or more features of any one embodiment can be combined with one or more features of one or more of the other embodiments, provided that such combination satisfies the intent of the present invention.

While a number of exemplary aspects and embodiments of the foldable surface 10 have been shown and/or disclosed herein, those of skill in the art will recognize certain modifications, permutations, additions and sub-combinations thereof. It is therefore intended that the system and method shall be interpreted to include all such modifications, permutations, additions and sub-combinations as are within their true spirit and scope, and no limitations are intended to the details of construction or design herein shown.

What is claimed is:

1. A foldable surface for supporting a user relative to a support surface during an activity, the foldable surface comprising:

a plurality of surface panels that are movably and undetachably coupled to one another with one or more panel connectors, at least some of the surface panels having a configuration that is triangular, each of the surface panels including (i) a rigid base layer having a base layer first surface that faces in a first direction, (ii) a resilient layer that is positioned adjacent to the base layer, the resilient layer having a resilient layer second surface that faces in a second direction that is substantially opposite the first direction, and (iii) a cover that completely covers the rigid base layer and the resilient layer to help maintain the relative positioning between the rigid base layer and the resilient layer, the surface panels being undetachably coupled to one another during movement between an open configuration wherein the plurality of surface panels cooperate to form a substantially planar surface that is adapted to be positioned adjacent to the support surface, and a stacked configuration wherein the surface panels are positioned with the base layer first surface of one surface panel directly facing the base layer first surface of an adjacent surface panel, wherein in the stacked configuration, the surface panels form a parallelogram-shaped footprint, at least one of the plurality of surface panels being positioned directly adjacent to other surface panels so that the at least one surface panel is completely bordered by adjacent surface panels on all sides when the foldable surface is in the open configuration.

2. The foldable surface of claim 1 wherein the rigid base layer is formed from at least one of tempered hardboard, bamboo, plywood, carbon fiber and aluminum.

3. The foldable surface of claim 1 wherein in the stacked position the resilient layer second surface of one surface panel directly faces the resilient layer second surface of an adjacent surface panel.

4. The foldable surface of claim 1 wherein the resilient layer is formed from at least one of thermoplastic elastomer, natural rubber and neoprene.

5. The foldable surface of claim 1 wherein the one or more panel connectors form a predetermined folding pattern between adjacent surface panels.

6. A foldable surface assembly comprising a plurality of foldable surfaces as in claim 1 that have been coupled together with a coupling assembly.

7. The foldable surface assembly of claim 6 wherein the plurality of foldable surfaces includes a first foldable surface and a second foldable surface; and wherein the second foldable surface is movably coupled to the first foldable surface with the coupling assembly so that the foldable surface assembly can be alternatively positioned in a first configuration and a second configuration that is different than the first configuration.

8. The foldable surface of claim 1 wherein the surface panels being foldable relative to one another in at least two non-perpendicular and non-parallel directions.

9. A foldable surface for supporting a user relative to a support surface during an activity, the foldable surface comprising:

a plurality of surface panels that are movably and undetachably coupled to one another with panel connectors, each of the surface panels having a first surface and an opposing second surface, the surface panels being undetachably coupled to one another during movement between an open configuration wherein the first surfaces of the plurality of surface panels cooperate to form a substantially planar surface that is adapted to be positioned adjacent to the support surface, and a stacked configuration wherein the surface panels are positioned substantially side-by-side with the first surface of one surface panel directly facing the first surface of an adjacent surface panel, and wherein in the stacked configuration, the surface panels form a parallelogram-shaped footprint;

wherein the panel connectors form a predetermined folding pattern between adjacent surface panels;

wherein at least some of the surface panels have a configuration that is substantially triangle-shaped; and wherein at least one of the plurality of surface panels is positioned directly adjacent to other surface panels so that the at least one surface panel is completely bordered by adjacent surface panels on all sides when the foldable surface is in the open configuration.

10. The foldable surface of claim 9 wherein the first surface is rigid, and wherein the second surface is resilient.

11. The foldable surface of claim 9 wherein each of the plurality of surface panels includes a rigid base layer and a resilient layer that is positioned adjacent to the rigid base layer.

12. The foldable surface of claim 11 wherein the rigid base layer is formed from at least one of tempered hardboard, plywood, and aluminum.

13. The foldable surface of claim 11 wherein the resilient layer is formed from at least one of thermoplastic elastomer, natural rubber and neoprene.

14. The foldable surface of claim 11 further comprising a cover that completely covers the rigid base layer and the resilient layer to help maintain the relative positioning between the rigid base layer and the resilient layer.

15. A foldable surface assembly comprising a plurality of foldable surfaces as in claim 9 that have been coupled together with a coupling assembly.

16. The foldable surface of claim 9 wherein the surface panels being foldable relative to one another in at least two non-perpendicular and non-parallel directions.

17. A method for supporting a user relative to a support surface during an activity, the method comprising the steps of:

movably and undetachably coupling a plurality of surface panels to one another with one or more panel connectors, at least some of the surface panels having a configuration that is triangular, each of the surface panels including (i) a rigid base layer having a base layer first surface that faces in a first direction, (ii) a resilient layer that is positioned adjacent to the base layer, the resilient layer having a resilient layer second surface that faces in a second direction that is substantially opposite the first direction, and (iii) a cover that completely covers the rigid base layer and the resilient layer to help maintain the relative positioning between the rigid base layer and the resilient layer; and moving the surface panels relative to one another between an open configuration wherein the plurality of surface panels cooperate to form a substantially planar surface that is adapted to be positioned adjacent to the support surface, and a stacked configuration wherein the surface panels are positioned substantially side-by-side with the base layer first surface of one surface panel directly facing the base layer first surface of an adjacent surface panel, the surface panels being foldable relative to one another in at least two non-perpendicular and non-parallel directions, at least one of the plurality of surface panels being positioned directly adjacent to other surface panels so that the at least one surface panel is completely bordered by adjacent surface panels on all sides when the foldable surface is in the open configuration.

18. The method of claim 17 wherein the step of movably, undetachably coupling includes the rigid base layer being formed from at least one of tempered hardboard, bamboo, plywood, carbon fiber and aluminum.

19. The method of claim 17 wherein the step of movably, undetachably coupling includes the resilient layer being formed from at least one of thermoplastic elastomer, natural rubber and neoprene.

20. The method of claim 17 wherein in the stacked configuration, the surface panels form a parallelogram-shaped footprint.

* * * * *